US007410449B2

(12) United States Patent
Yeh

(10) Patent No.: US 7,410,449 B2
(45) Date of Patent: Aug. 12, 2008

(54) MULTIFUNCTIONAL EXERCISE TREADMILL WITH SENSOR FOR ACTIVATING MOTOR DRIVEN TREAD BELT OR NOT IN RESPONSE TO FORCE EXERTED UPON THE TREAD BELT FOR ADDITIONALLY EXERCISING EITHER FOOT MUSCLES OR BOTH FOOT AND HAND MUSCLES

(75) Inventor: Don-Lon Yeh, Taichung (TW)

(73) Assignee: Sing Lin Technology Co., Ltd., Taichung (TW)

( * ) Notice: Subject to any disclaimer, the term of this patent is extended or adjusted under 35 U.S.C. 154(b) by 198 days.

(21) Appl. No.: 11/497,323

(22) Filed: Aug. 2, 2006

(65) Prior Publication Data

US 2008/0032871 A1 Feb. 7, 2008

(51) Int. Cl.
*A63B 22/00* (2006.01)

(52) U.S. Cl. ..... 482/57; 482/51; 482/54

(58) Field of Classification Search ..... 482/51, 482/54, 57; 119/700; 434/247
See application file for complete search history.

(56) References Cited

U.S. PATENT DOCUMENTS

| | | | | |
|---|---|---|---|---|
| 5,690,587 | A * | 11/1997 | Gruenangerl | 482/54 |
| 6,409,633 | B1 * | 6/2002 | Abelbeck | 482/54 |
| 6,645,126 | B1 * | 11/2003 | Martin et al. | 482/54 |
| 2005/0164839 | A1 * | 7/2005 | Watterson et al. | 482/54 |

* cited by examiner

*Primary Examiner*—Glenn Richman
(74) *Attorney, Agent, or Firm*—Bacon & Thomas, PLLC.

(57) ABSTRACT

An exercise treadmill includes a tread belt wrapped around front and rear rolls, a motor, a frame, a control panel, a sensor electrically connected to the motor for sensing a rotation of its driving shaft and generating a sense signal if sensing the rotation, and a controller electrically interconnected the sensor and the control panel for receiving the sense signal and generating and sensing a control signal to the motor. The motor may either stop the rotation of the driving shaft for maintaining the tread mill motionless in response to the user's foot impact thereon less than or equal to a predetermined reverse force or oppose a movement of the tread belt in response to the impact larger than the reverse force. Moreover, the tread belt either maintains at its current position or returns to its original position in response to stopping exercise.

3 Claims, 6 Drawing Sheets

MULTIFUNCTIONAL EXERCISE TREADMILL WITH SENSOR FOR ACTIVATING MOTOR DRIVEN TREAD BELT OR NOT IN RESPONSE TO FORCE EXERTED UPON THE TREAD BELT FOR ADDITIONALLY EXERCISING EITHER FOOT MUSCLES OR BOTH FOOT AND HAND MUSCLES

BACKGROUND OF THE INVENTION

1. Field of Invention

The present invention relates to power driven exercise treadmills and more particularly to a multifunctional exercise treadmill having a sensor and a controller for activating a motor driven tread belt only when a load on the belt resulting from the user's foot impact on the belt is larger than a reverse force which is set as and obtained from a function of the motor's horsepower.

2. Related Art

The fitness craze which has captivated the attention of ever increasing numbers of people in the world has spawned an endless array of exercise equipment. However, only some of it is beneficial. One particular area of concentration for manufacturers of exercise equipment has been exercise treadmills. A conventional exercise treadmill comprises two spaced rolls, an endless tread belt wrapped around the rolls, a motor for driving the rolls, a control panel incorporating controller and circuitry for controlling the motor, and a frame for mounting the above components.

Typically, a user walks or runs on the running tread belt after activating the motor. Some types of exercise treadmills have the additional functions of vibration, simulating a mountain climbing, etc. However, there are no available exercise treadmills capable of exercising foot muscles and/or muscles of other parts of the body so far as the present inventor is aware. Thus, the need for improvement still exists.

SUMMARY OF THE INVENTION

It is therefore an object of the present invention to provide an exercise apparatus comprising front and rear rolls; a moving tread belt wrapped around the rolls, a user being capable of walking, running, or sitting on the tread belt; a motor having a driving shaft, a belt wrapped around the front roll and an open end of the driving shaft, and a reduction gear at one side of the front roll such that the driving shaft is adapted to rotate the front roll when the motor activates; a frame with the rolls, the tread belt, and the motor mounted and including two front uprights; a control panel mounted on a top of the uprights; a sensor electrically connected to the driving shaft for sensing a rotation of the driving shaft and generating a sense signal if the sensor senses the rotation of the driving shaft; and a controller electrically interconnected the sensor and the control panel, the controller adapted to receive the sense signal and generate a control signal which is in turn sent back to the motor; wherein the control signal commands the motor to activate to generate a reverse force to either (i) stop the rotation of the driving shaft in substantially real time for maintaining the tread mill motionless in response to the user's foot impact on the tread mill less than or equal to a predetermined reverse force or (ii) oppose a movement of the tread belt in substantially real time in response to the user's foot impact on the tread mill larger than the predetermined reverse force; and wherein either after moving the tread belt, the tread belt maintains at its current position in response to stopping exercise or the user's foot impact on the tread mill is less than or equal to the predetermined reverse force; or the movement of the tread belt involves firstly moving the tread belt rearward, and secondly moving the tread belt forward to its original position in response to stopping exercise or the user's foot impact on the tread mill being less than or equal to the predetermined reverse force. By utilizing the present invention, a user can additionally exercise either foot muscles or both foot and hand muscles.

In one aspect of the present invention there is further provided a seat for permitting the user to sit thereon, a cross rail interconnecting the uprights, and two foot rests mounted on the cross rail.

In another aspect of the present invention the frame further comprises two side levels adjacent the seat.

The above and other objects, features and advantages of the present invention will become apparent from the following detailed description taken with the accompanying drawings.

DETAILED DESCRIPTION OF THE INVENTION

Figure 1:
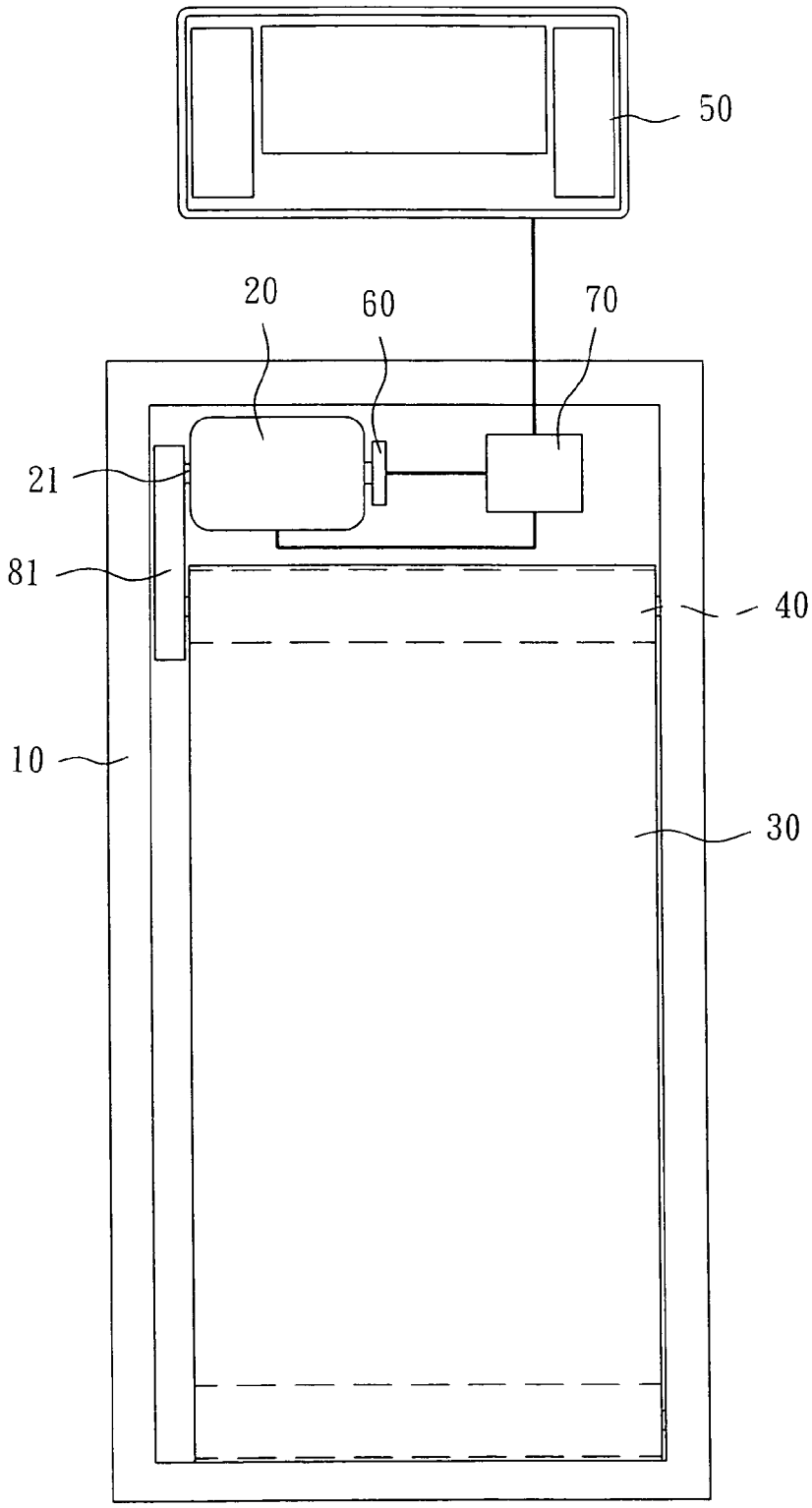
FIG. 1 is schematic view of a preferred embodiment of exercise treadmill according to the invention.
Figure 2:
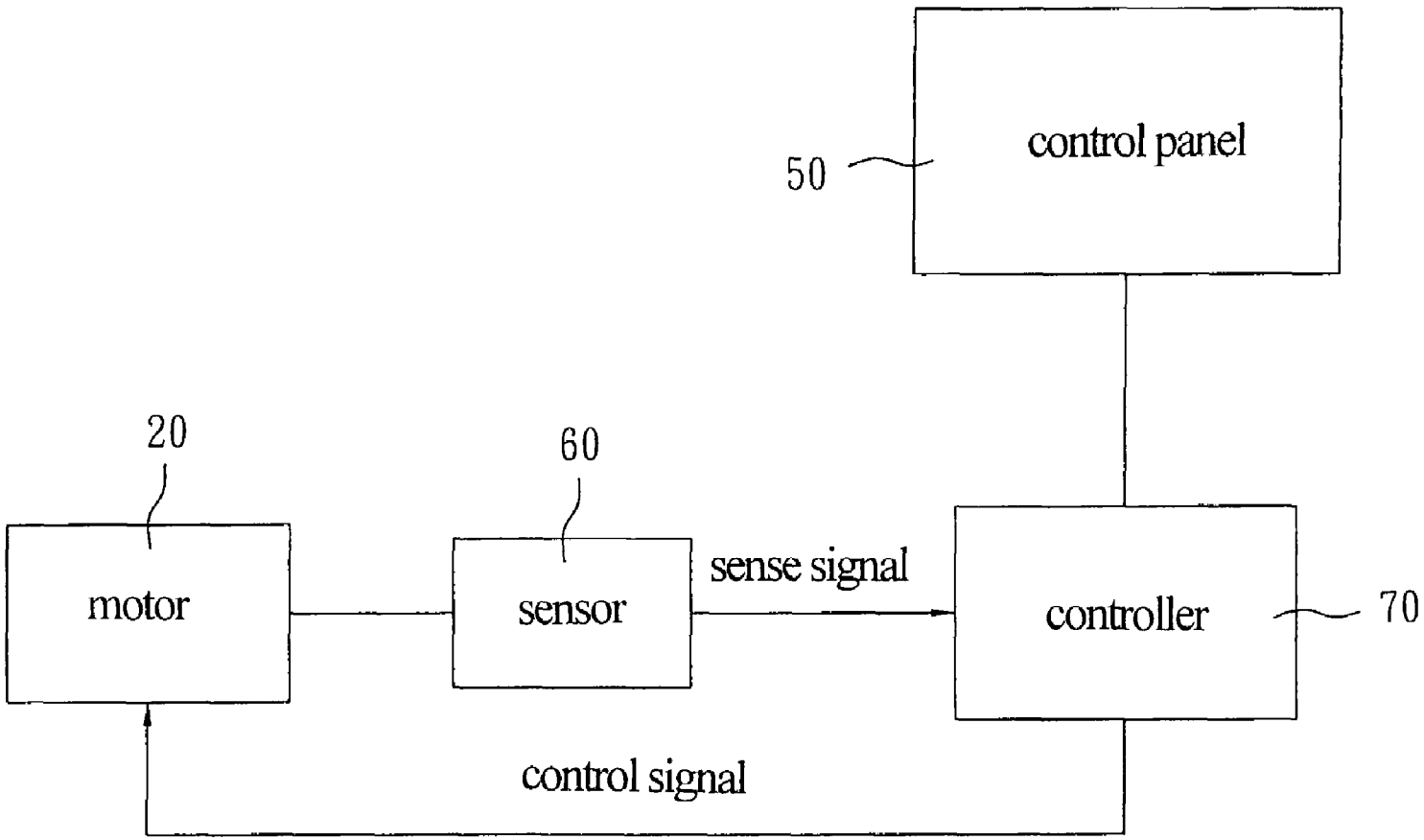
FIG. 2 is a block diagram of the electrical components of the exercise treadmill.

Referring to FIGS. 1 to 6, an exercise treadmill in accordance with a preferred embodiment of the invention comprises two spaced rolls 40, an endless tread belt 30 wrapped around the rolls 40, a motor 20 for driving the rolls 40, a control panel 50 incorporating circuitry and other electrical components as detailed later for controlling the motor 20, and a frame 10 including two front uprights for mounting the above components.

The motor 20 has an extending driving shaft 21 operatively connected to the front roll (e.g., drive roll) 40 via a belt 81 wrapped around the front roll 40 and the open end of the driving shaft 21, and a connected reduction gear 82 at one side. As such, the front roll 40 can continuously rotate in a predetermined speed when the motor 20 powers on. This is well known in the art and a detailed description thereof is therefore deemed unnecessary.

The characteristics of the invention are detailed below. A sensor 60 is provided to sense whether the driving shaft 21, for example clockwise, rotates a predetermined minimum angle due to a force exerted upon the tread belt 30 (e.g., a user's foot impact on the tread belt 30). A sense signal is generated by the sensor 60 if the sensor 60 senses a rotation of the driving shaft 21. A controller 70 is provided to electrically interconnect the sensor 60 and the control panel 50. The controller 70 is adapted to receive the sense signal and generate a control signal which is in turn sent back to the motor 20. The control signal commands the motor 20 to generate a reverse force to stop the clockwise rotation of the driving shaft 21 in substantially real time. As a result, the driving shaft 21 maintains motionless whenever a load on the tread belt 30 resulting from the user's foot impact thereon is less than or equal to a predetermined reverse force (i.e., the set reverse force) as detailed below. This characteristic is beneficial to the exercise of either foot muscles or both foot and hand muscles as detailed below.

A predetermined reverse force (e.g., motor input current I (variable)×a motor torque constant Kt) is obtained from a function of the motor's horsepower. The predetermined reverse force can be set by a user depending on the desired strength of exercise. Thus, the tread belt 30 is motionless when a load on the tread belt 30 resulting from the user's foot impact thereon is less than or equal to the predetermined reverse force (i.e., the set reverse force). To the contrary, the tread belt 30 moves when the load is larger than the set reverse force with the motor 20 (i.e., the driving shaft 21) rotating clockwise in opposing the movement of the tread belt 30.

The set reverse force can be displayed on the control panel 50. Also, force exerted by either the feet or both the feet and the hands can be displayed on the control panel 50. As such, a user can visually compare them each other as a basis for adjustment if such need arises.

Figure 4:
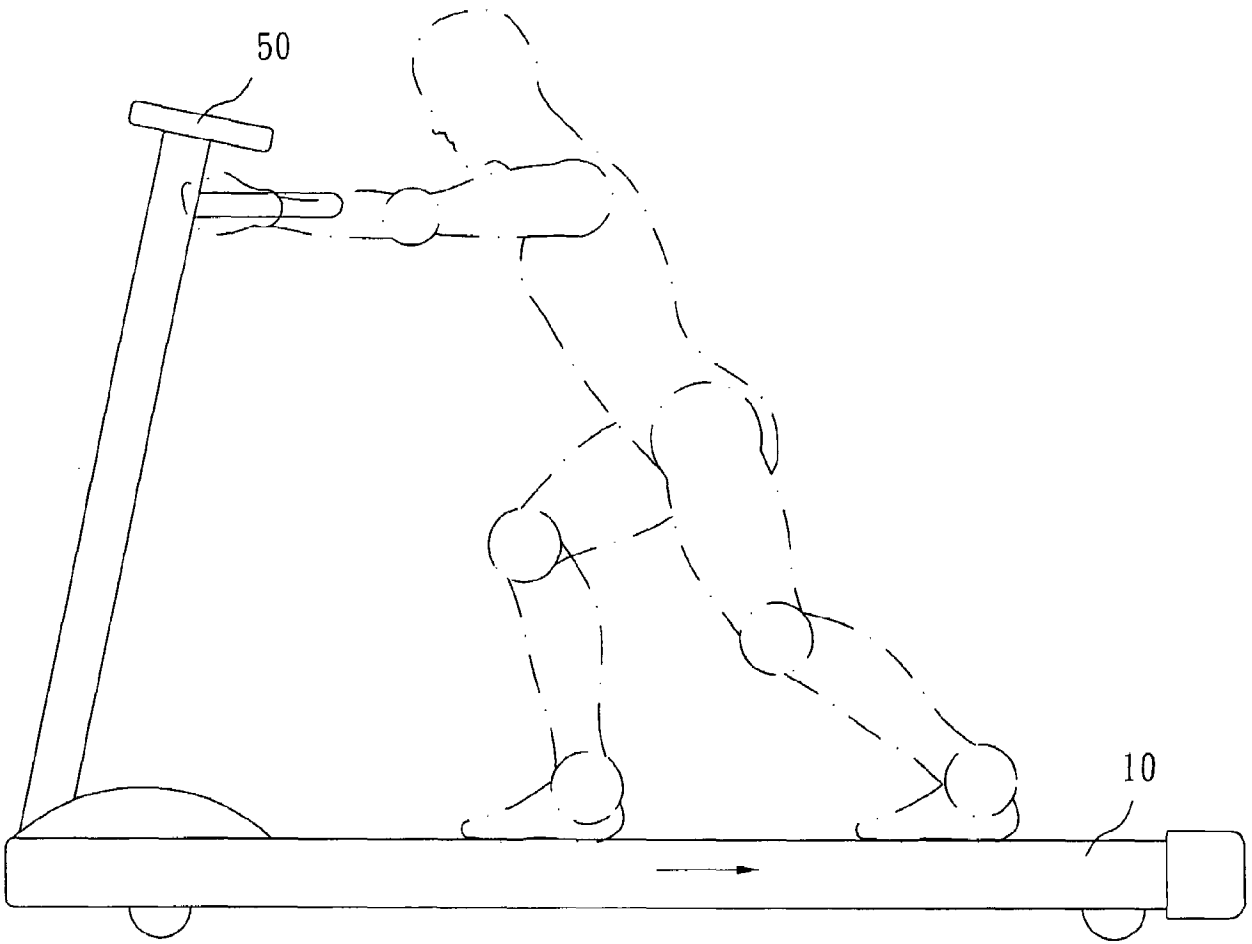
FIG. 4 is a side elevation of the exercise treadmill schematically showing a user walking on the tread belt for exercising his foot muscles.
Figure 6:
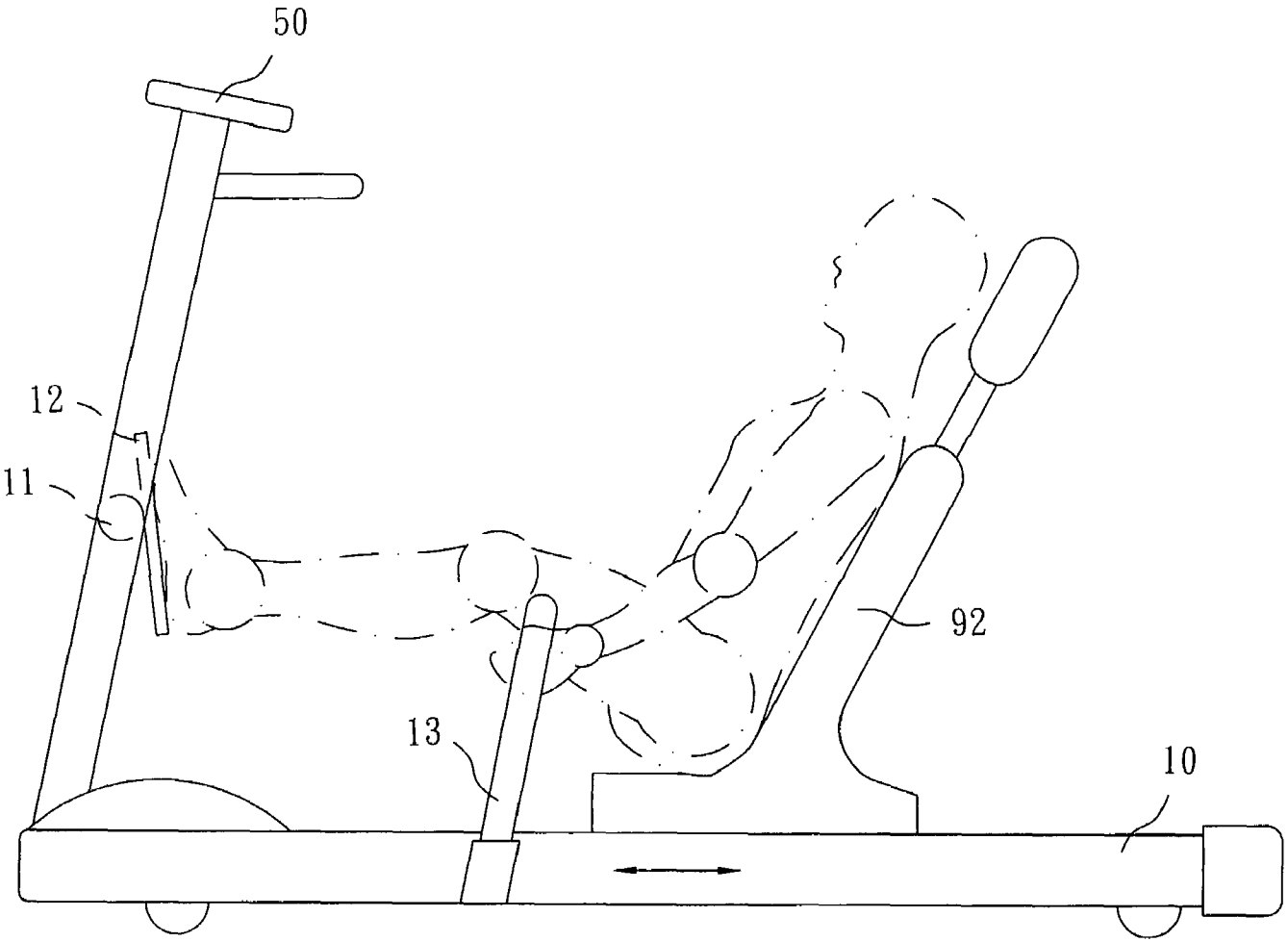
FIG. 6 is a view similar to FIG. 5 where the user is additionally holding two side levels and exerting force thereupon for moving the tread belt back and forth so as to exercise his hand muscles in addition to the foot muscles.

Moreover, a user may use either of two exercise modes to exercise his muscles. The characteristic of the first exercise mode is detailed below. The tread belt 30 moves when a load on the tread belt 30 resulting from the user's foot impact thereon (i.e., the user is walking on the tread belt 30 for exercising the foot muscles as shown in FIG. 4 or the user sits on a seat 92 with the feet exerted force upon two foot rests 12 mounted on a cross rail 11 interconnecting two uprights of the frame 10 by additionally holding two side levels 13 and exerting force thereupon for moving the tread belt 30 back and forth for exercising both foot muscles and hand muscles as shown in FIG. 6) is larger than the set reverse force with the motor 20 (i.e., the driving shaft 21) rotating clockwise in opposing the movement of the tread belt 30. Also, the tread belt 30 maintains at its current position once the user stops exercising or the load on the tread belt 30 resulting from the user's foot impact thereon is less than or equal to the set reverse force.

Figure 5:
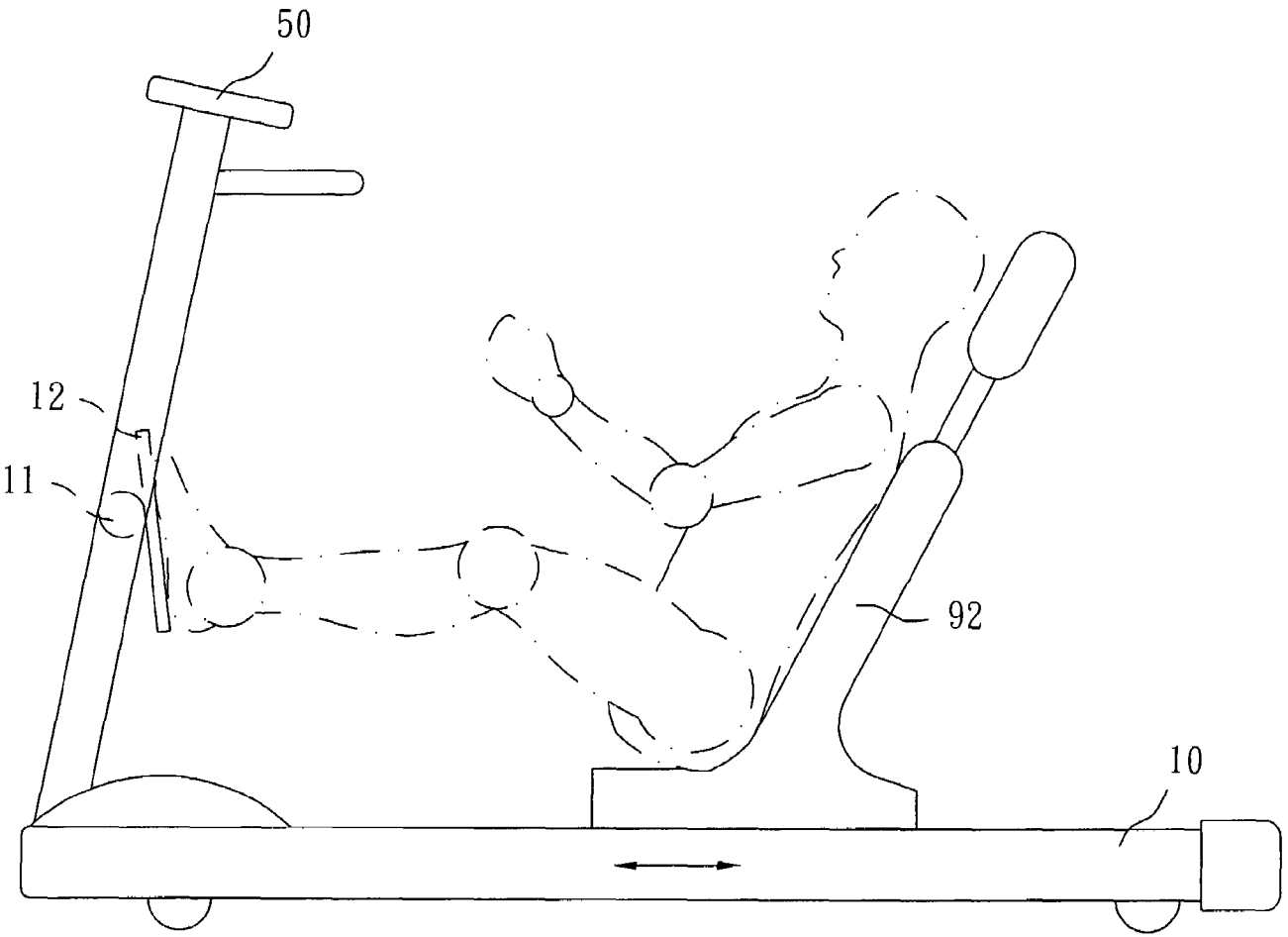
FIG. 5 is a side elevation of the exercise treadmill schematically showing a user exerting force upon two foot rests mounted on a cross rail interconnecting two uprights of the frame by sitting on a seat which is adapted to move back and forth on the tread belt for exercising his foot muscles.

The characteristic of the second exercise mode is detailed below. As shown in FIG. 5, the tread belt 30 first moves rearward when the user exerts force upon the foot rests 12 by sitting on the seat 92 and the force is larger than the set reverse force. Also, the controller 70 records revolutions and rotating angle of the driving shaft 21 as sensed by the sensor 60. Thus, the controller 70 generates a control signal in response to receiving a sense signal generated by the sensor 60 when a load on the tread belt 30 resulting from the user's foot impact thereon is less than or equal to the set reverse force. The control signal is then sent back to the motor 20. The control signal commands the motor 20 to counterclockwise rotate the driving shaft 21 to automatically move the tread belt 30 forward (i.e., return) to its original position. The second exercise mode is applicable to a user exerting force upon the foot rests 12 by sitting on the seat 92 adapted to move back and forth on the tread belt 30 for exercising his foot muscles.

Figure 3:
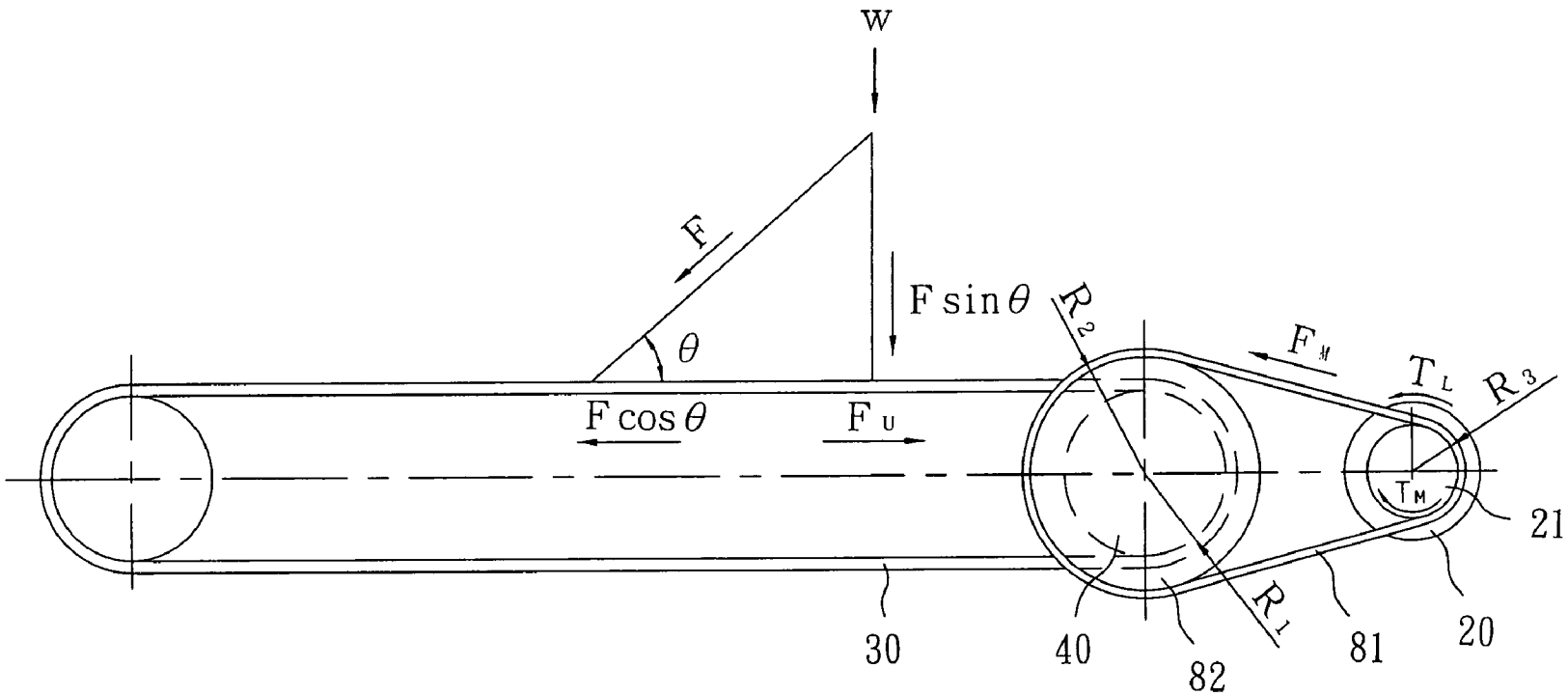
FIG. 3 schematically shows force of a user's feet exerted upon the tread belt.

As shown in FIG. 3 specifically, a plurality of parameters are defined below for explaining the principles of exercise as contemplated by the invention. F is a force exerted upon tread belt by a user, θ is an angle of a force exerted upon tread belt by a user, $F_u$ is friction, μ is friction coefficient between tread belt and frame, w is weight of user, $F_M$ is load on a belt associated with a front roll, $R_1$ is a radius of a front roll, $R_2$ is a radius of a portion of a belt put on a front roll, $R_3$ is a radius of a portion of a belt put on a driving shaft of motor, $T_L$ is torque of load, $T_M$ is output opposing torque of motor, $K_t$ is motor torque constant, I is motor input current (a variable), $I_{MAX}$ is a maximum motor current, and K is a ratio of I to $I_{MAX}$.

A plurality of expressions are defined below by employing the above parameters.

$$F_U = \mu(w + F\sin\theta); \tag{1}$$

$$(F\cos\theta - F_U)R_1 = F_M * R_2 \tag{2}$$
$$F_M = (R_1 / R_2)(F\cos\theta - F_U)$$

$$\begin{aligned} T_L &= F_M * R_3 \\ &= (R_1 * R_3 / R_2)(F\cos\theta - F_U) \\ &= (R_1 * R_3 / R_2)[F\cos\theta - \mu(w + F\sin\theta)] \\ &= (R_1 * R_3 / R_2)[F(\cos\theta - \mu F\sin\theta) - \mu w] \end{aligned} \tag{3}$$

$$T_M = K_t * I \tag{4}$$

$$T_L = T_M = K_t * I \tag{5}$$
$$I = (1 / K_t)(R_1 * R_3 / R_2)[F(\cos\theta - \mu F\sin\theta) - \mu w]$$

$$K = I / I_{\mathrm{MAX}} \tag{6}$$

Three exemplary exercise examples of the invention are detailed below. In FIG. 4, a user is walking on the tread belt 30 by putting his hands on the uprights of the frame 10 with his body slightly inclined. The tread belt 30 moves when a load on the tread belt 30 resulting from the user's foot impact thereon is larger than the set reverse force. Also, the tread belt 30 maintains at its current position once the user stops exercising or the load on the tread belt 30 resulting from the user's foot impact thereon is less than or equal to the set reverse force. The first example demonstrates how to exercise the foot muscles.

In FIG. 5, a user exerts force upon two foot rests 12 mounted on a cross rail 11 interconnecting two uprights of the frame 10 by sitting on a seat 92 for moving the tread belt 30 rearward initially. The motor 20 as controlled by the controller 70 may automatically bring the user to its original position via the driving shaft 21, the belt 81, the reduction gear 82, the front roll 40, and the tread belt 30 in response to stopping the force exertion or the load on the tread belt 30 resulting from the user's foot impact thereon is less than or equal to the set reverse force. (i.e., the implementation of the second exercise mode). The second example demonstrates how to exercise the foot muscles by moving back and forth by sitting on the seat 92 on the tread belt 30.

In FIG. 6, a user sits on the seat 92 with the feet exerted force upon the foot rests 12 mounted on the cross rail 11 interconnecting two uprights of the frame 10 by additionally holding two side levels 13 and exerting force thereupon for moving the tread belt 30 back and forth (i.e., the implementation of the first exercise mode). Also, the tread belt 30 maintains at its current position once the user stops exercising or the load on the tread belt 30 resulting from the user's foot impact thereon is less than or equal to the set reverse force. The third example demonstrates how to exercise both the foot muscles and the hand muscles.

In brief, the exercise treadmill of the invention can additionally exercise either the foot muscles or both the foot muscles and the hand muscles by simply incorporating a sensor 60 and a controller 70 into a typical exercise treadmill.

While the invention herein disclosed has been described by means of specific embodiments, numerous modifications and variations could be made thereto by those skilled in the art without departing from the scope and spirit of the invention set forth in the claims.

What is claimed is:

1. An exercise apparatus comprising:

front and rear rolls;

a moving tread belt wrapped around the rolls, a user being capable of walking, running, or sitting on the tread belt;

a motor having a driving shaft, a belt wrapped around the front roll and an open end of the driving shaft, and a reduction gear at one side of the front roll such that the driving shaft is adapted to rotate the front roll when the motor activates;

a frame with the rolls, the tread belt, and the motor mounted and including two front uprights;

a control panel mounted on a top of the uprights;

a sensor electrically connected to the driving shaft for sensing a rotation of the driving shaft and generating a sense signal if the sensor senses the rotation of the driving shaft; and a controller electrically interconnected the sensor and the control panel, the controller adapted to receive the sense signal and generate a control signal which is in turn sent back to the motor;

wherein the control signal commands the motor to activate to generate a reverse force to either (i) stop the rotation of the driving shaft in substantially real time for maintaining the tread mill motionless in response to the user's foot impact on the tread mill less than or equal to a predetermined reverse force or (ii) oppose a movement of the tread belt in substantially real time in response to the user's foot impact on the tread mill larger than the predetermined reverse force; and wherein either after moving the tread belt, the tread belt maintains at its current position in response to stopping exercise or the user's foot impact on the tread mill is less than or equal to the predetermined reverse force; or the movement of the tread belt involves firstly moving the tread belt rearward, and secondly moving the tread belt forward to its original position in response to stopping exercise or the user's foot impact on the tread mill being less than or equal to the predetermined reverse force.

2. The exercise apparatus of claim 1, further comprising a seat for permitting the user to sit thereon, a cross rail interconnecting the uprights, and two foot rests mounted on the cross rail.

3. The exercise apparatus of claim 1, wherein the frame further comprises two side levels adjacent the seat.

* * * * *